US007424838B2

(12) United States Patent
Li et al.

(10) Patent No.: US 7,424,838 B2
(45) Date of Patent: Sep. 16, 2008

(54) COMBINATION PLIERS AND ADJUSTABLE WRENCH

(75) Inventors: Peng Li, Ellicott City, MD (US); Fengping Zhu, Shanghai (CN)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 11/594,370

(22) Filed: Nov. 8, 2006

(65) Prior Publication Data

US 2008/0104765 A1 May 8, 2008

(51) Int. Cl.
*B25B 13/16* (2006.01)

(52) U.S. Cl. ..... 81/165; 81/179; 7/129; 7/139

(58) Field of Classification Search ..... 81/165, 81/315, 329–333, 385, 390, 418, 126, 129, 81/169, 179; 7/125, 129, 132–134, 139
See application file for complete search history.

(56) References Cited

U.S. PATENT DOCUMENTS

| | | | | | |
|---|---|---|---|---|---|
| 874,394 | A | * | 12/1907 | Cork et al. | 81/332 |
| 3,175,437 | A | * | 3/1965 | Arakawa | 81/329 |
| 3,383,963 | A | | 5/1968 | Vondrachek | |
| 3,798,687 | A | | 3/1974 | Stevens | |
| 3,858,258 | A | * | 1/1975 | Stevens | 81/315 |
| 4,104,794 | A | | 8/1978 | Carroll | |
| 4,794,824 | A | | 1/1989 | Chapman | |
| 5,150,488 | A | | 9/1992 | Yuan et al. | |
| 5,373,866 | A | | 12/1994 | Whalen | |
| 5,535,650 | A | * | 7/1996 | McNatt | 81/165 |
| D374,389 | S | * | 10/1996 | Lin | D8/105 |
| 6,145,144 | A | | 11/2000 | Poehlmann | |
| 2002/0124414 | A1 | | 9/2002 | Yang | |
| 2004/0163505 | A1 | | 8/2004 | Durham et al. | |
| 2006/0236823 | A1 | * | 10/2006 | MacLain | 81/418 |

FOREIGN PATENT DOCUMENTS

| | | |
|---|---|---|
| FR | 817298 | 8/1937 |

* cited by examiner

*Primary Examiner*—Hadi Shakeri
(74) *Attorney, Agent, or Firm*—Nelson Mullins Riley & Scarborough, LLP

(57) ABSTRACT

A hand tool comprising a first member having a handle with fixed jaw, a jaw face and a first pivot portion, the first pivot portion defining a first pivot hole having a center positioned at a distance from the fixed jaw face second end within the range of about 10 to 15 millimeters; a second member having a slot, a handle, a second pivot portion, a recess, and a worm gear rotatably received in the recess; a pivot pin pivotally connecting the first and second pivot holes and having a diameter within the range of about 6 to 10 millimeters; a sliding jaw having a face, and a gear rack slidably received by the second member slot and engaging the worm gear; and a detent selectively movable to prevent the pivotal movement of the first and second members with respect to each other.

15 Claims, 9 Drawing Sheets

COMBINATION PLIERS AND ADJUSTABLE WRENCH

FIELD OF THE INVENTION

This invention relates generally to multi-function hand tools and more particularly to a hand tool incorporating the functions of an adjustable wrench, pliers, and wire cutting dykes.

BACKGROUND OF THE INVENTION

In various industrial arts, skilled laborers use a variety of tools that are each designed to perform a unique task. Many laborers carry a full compliment of tools to ensure that they have the necessary tools to complete the job. Unfortunately, a full set of tools is an expensive investment that requires a heavy tool box or other carrying case that may be both cumbersome and difficult to transport.

Prior attempts to combine similar tools into one multi-function tool have generally failed to provide a tool that is equally adept at performing the function of each particular tool. A number of designs merge the functions of an adjustable wrench with a pair of pliers, but the arrangement of the various moving parts limits the utility and ultimately reduces the strength of the tool. For example, U.S. Patent Application Publication 2004/0163505 discloses a combination plies and adjustable wrench that includes a first handle having a fixed jaw and a second handle having a sliding jaw. A pivot pin pivotally connects the first and second handles. An adjustable worm gear in the second handle allows the user to slide the sliding jaw towards or away from to the fixed jaw. However, the worm gear is positioned at the center of the pivotal connection between the first handle and the second handle, which creates two deficiencies in the tool. First, locating the worm gear inside the pivotal connection increases the distance between the pivot point and the two jaw faces, which reduces the amount of gripping leverage that a user can impart when using the tool as a pair of pliers. Second, locating the worm at the center of the pivot point requires that material must be removed from the pivot point to accommodate the worm gear. Because this area of the tool transmits all of the gripping and turning force that the user applies when using the tool, removing material in this area greatly reduces the mechanical strength of the tool. Moreover, the worm at the center of the pivot makes the connection between the two handles difficult to design and manufacture.

As a second example, U.S. Pat. No. 3,798,687 discloses a similar combination adjustable wrench and pliers tool, but the worm gear and shape of the sliding jaw are such that the pivot point for the two handles is located at a distance far enough from the engaging jaw faces to significantly reduce the amount of gripping leverage that may be imparted by the tool.

Finally, U.S. Pat. No. 5,150,488 discloses a similar combination adjustable wrench and pliers tool with the worm gear for driving the adjustable jaw located adjacent from the pivot point. However, the tool uses a locking detent mechanism that is positioned about the pivot point in such a way that requires the removal of a great deal of material from the handles, which increases the distance between the pivot point and the engaging jaw faces. This arrangement weakens the mechanical strength and durability of the tool and reduces the mechanical advantage that the user may impart by the tool.

Recognizing the limitations and shortcomings of the prior art, the present invention represents an improved combination pliers and adjustable wrench that offers solutions to problems presented by prior art designs.

SUMMARY OF THE INVENTION

The present invention recognizes and addresses disadvantages of prior art constructions and methods, and it is an object of the present invention to provide a multi-function hand tool incorporating at least the functions of an adjustable wrench, pliers, and wire cutting dykes. This and other objects may be achieved by a hand tool comprising a first member having a handle, a fixed jaw having a face defining a first end distal from the handle and a second end proximate to the handle, and a first pivot portion intermediate the fixed jaw and the handle. The first pivot portion defines a first pivot hole having a center positioned at a distance from the fixed jaw face second end within the range of about 7 to 15 millimeters. A second member has a slot transverse to an axis of the second member, a handle, a second pivot portion proximate to the slot and defining a second pivot hole, a recess defined through the second member proximate to the second member slot and disposed radially outward from the second member second pivot hole, and a worm gear rotatably received in the recess. A pivot pin pivotally connects the first and second members so that the first the second members pivot between a fully closed position and a fully open position. The pivot pin has a diameter within the range of about 4 to 10 millimeters and is received in both the first member first pivot hole and the second member second pivot hole. A sliding jaw has a face, and a gear rack, the sliding jaw face having a first end distal from the sliding jaw gear rack and a second end proximate the gear rack, where the sliding jaw gear rack is slidably received by the second member slot. The gear rack engages the worm gear such that rotation of the worm gear moves the sliding jaw within the second member slot. A detent is selectively movable to prevent the pivotal movement of the first member and the second member with respect to each other.

In a second embodiment, a hand tool comprises a first member having a handle, a fixed jaw having a face defining a first end distal from the handle and a second end proximate to the handle, and a first pivot portion intermediate the fixed jaw and the handle and defining a first pivot hole. A second member has a slot transverse to an axis of the second member, a handle, a second pivot portion proximate to the slot defining a second pivot hole, a recess defined through the second member proximate to the second member slot and disposed radially outward from the second member pivot point, and a worm gear rotatably received in the recess. A pivot pin is received in both of the first and second pivot holes and pivotally connects the first member first pivot portion and the second member second pivot portion so that the first and second members pivot between a fully closed position and a fully open position. The pivot pin has a diameter within the range of about 4 to 10 millimeters. A sliding jaw has a gear rack slidably received by the second member slot so as to engage the worm gear so that rotation of the worm gear causes the sliding jaw to move within the slot, and a jaw face having a first end distal from the sliding jaw gear rack and a second end proximate to the gear rack. A detent is moveable to prevent the pivotal movement of the first member and the second member with respect to each other.

In a third embodiment, a hand tool comprises a first member having a handle, a fixed jaw having a face defining a first end distal from the handle and a second end proximate to the handle, and a first pivot portion intermediate the fixed jaw and the handle defining a first pivot hole, the first pivot hole having a center positioned at a distance from the fixed jaw face second end within the range of about 7 to 15 millimeters. A second member has a slot transverse to an axis of the second member, a handle, a second pivot portion proximate to the slot defining a second pivot hole, a recess defined through the second member proximate to the second member slot and disposed radially outward from the second member pivot point, and a worm gear rotatably received in the recess. A pivot pin received in both the first and second pivot holes and pivotally connecting the first member first pivot portion and the second member second pivot portion so that the first and second members pivot about the first and second pivot points between a fully closed position and a fully open position. A sliding jaw having a gear rack slidably received by the second member slot so as to engage the worm gear so that rotation of the worm gear causes the sliding jaw to move within the slot. A jaw face has a first end distal from the sliding jaw gear rack and a second end proximate to the gear rack. A detent selectively prevents the pivotal movement of the first member and the second member with respect to each other.

BRIEF DESCRIPTION OF THE DRAWINGS

A full and enabling disclosure of the present invention, including the best mode thereof directed to one of ordinary skill in the art, is set forth in the specification, which makes reference to the appended figures, in which.

Figure 1:
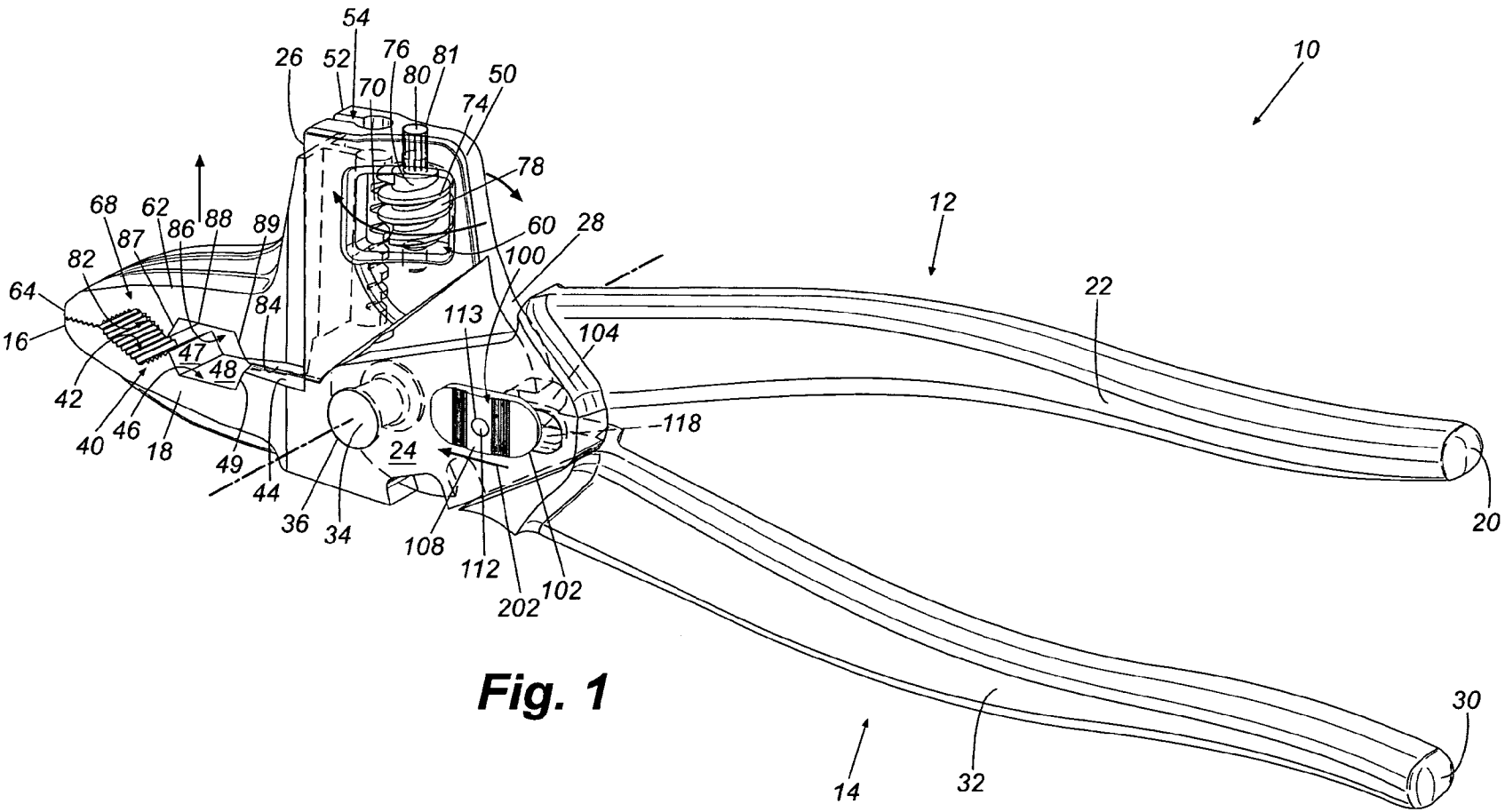
FIG. 1 is a front perspective view of a hand tool in accordance with an embodiment of the present invention shown in a first operating position.

Repeat use of reference characters in the present specification and drawings is intended to represent same or analogous features or elements of the invention.

DETAILED DESCRIPTION

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
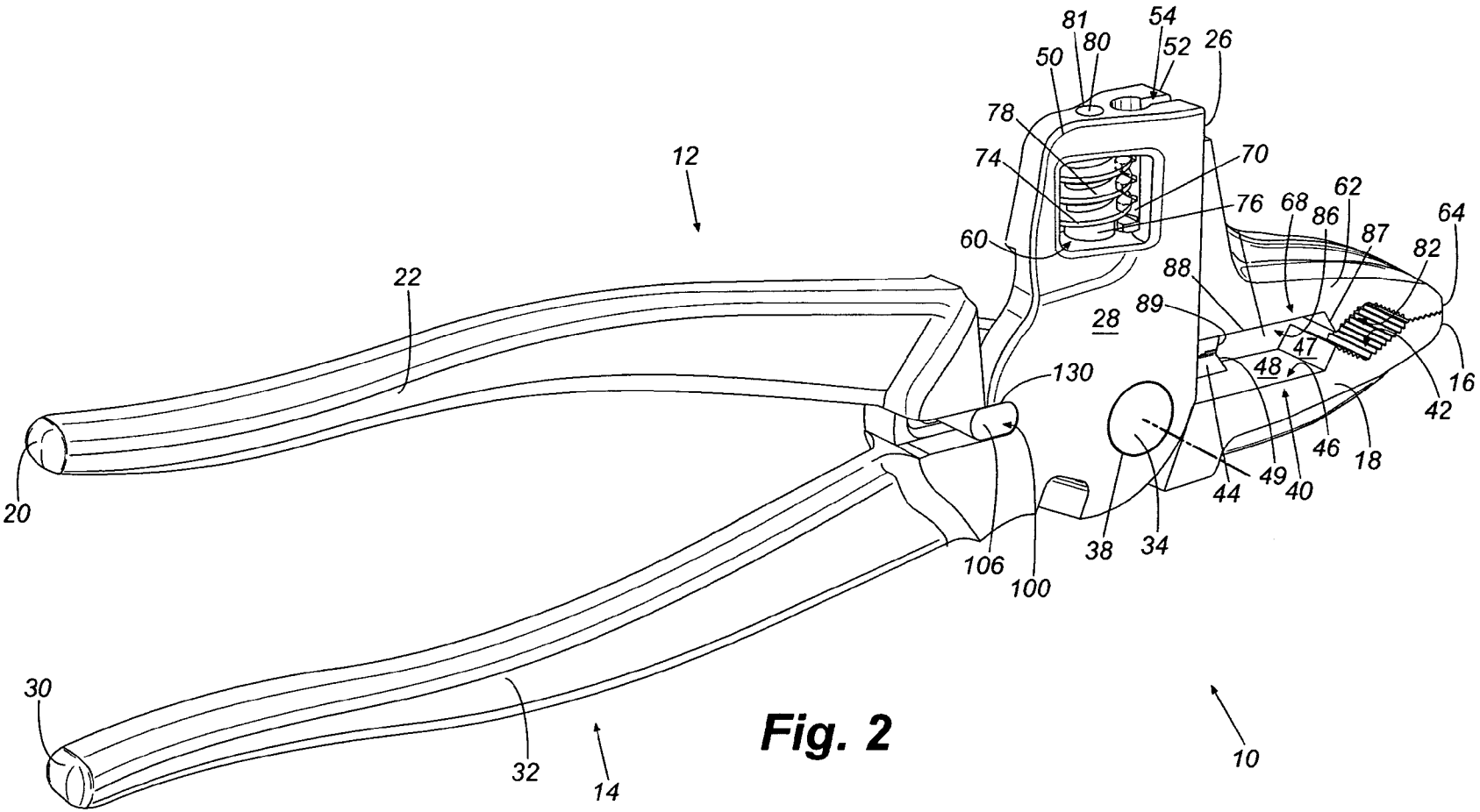
FIG. 2 is a rear perspective view of the hand tool of FIG. 1.
Figure 3:
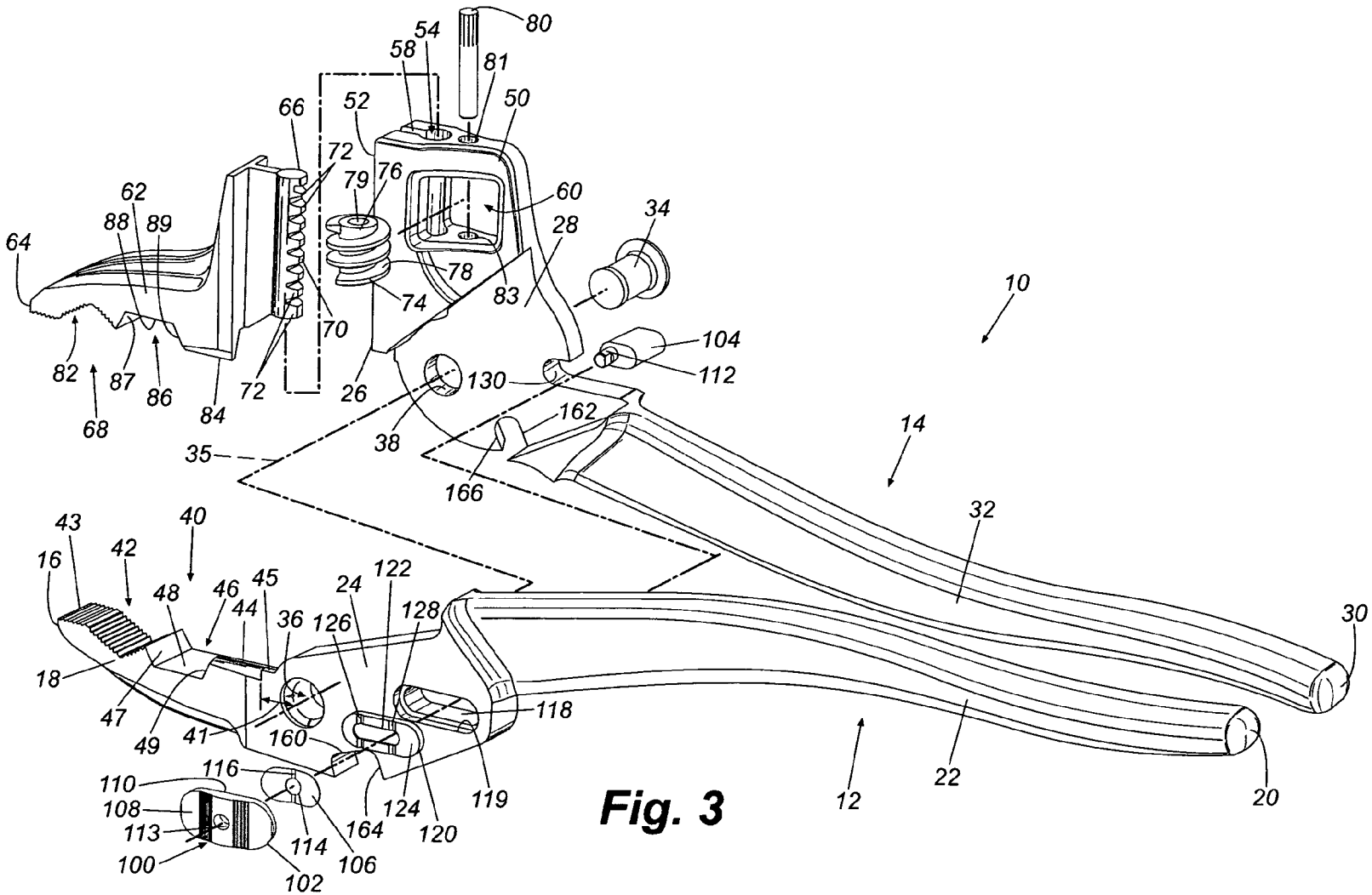
FIG. 3 is an exploded view of the hand tool of FIG. 1.

FIGS. 1-3 show a preferred embodiment of a hand tool 10 that preferably combines the functions of a typical pair of pliers and an adjustable wrench, among other things. Hand tool 10 has a first member 12 and a second member 14. First member 12 has a first end 16 that defines a jaw 18, a second end 20 that defines a first handle 22, and a pivot portion 24 formed between the jaw and the first handle. Second member 14 has a first end 26 that defines a pivot portion 28 and a second end 30 that defines a second handle 32. First member 12 and second member 14 may pivot with respect to each other about a pivot pin 34 press-fitted into a first pivot hole 36 (FIG. 3) formed in first pivot portion 24 and pivotally received by a second pivot hole 38 (FIG. 3) formed in second pivot portion 28. It should be understood that pivot pin 34 may be a rivet, a threaded bolt with an accompanying nut, or other similar arrangement suitable for allowing the first and second members to pivot relative to each other. As explained in further detail below, the location of first pivot hole 36 is preferably as close as possible to first member jaw 18, and second pivot hole 38 is preferably located as close as possible to second member first end 26 in order to minimize the distance between a center 35 of pivot pin 34 and second member first end 26. In one preferred embodiment, the diameter of pin 34 is within the range of about 6 to 10 millimeters. It should be understood that the diameter of pin 34 may also be larger, but in all embodiments, the diameter of pin 34 is minimized to move pivot pin center 35 as close to the jaws as possible while maximizing the tool's structural integrity and mechanical advantage.

First member jaw 18 has a jaw face 40 having a first end 43 located distal from first member pivot portion 24, and a second end 45 proximate to the first member pivot portion. In one preferred embodiment, jaw face 40 may have a grasping region 42 located proximate to first member first end 16 that is suitable for grasping work pieces as described below. Jaw face 40 may also have a wire cutting edge 44 located proximate to first member pivot portion 24 (FIGS. 1 and 3). Referring back to FIGS. 1-3, jaw face 40 preferably includes a bolt turning region 46 that includes three flat surfaces 47, 48, and 49 for engaging the flat surfaces of a hexagonal bolt head, nut, or the flat surfaces on many common pipe fittings and other similar hardware. It should be understood that jaw face 40 may have other regions suited for other functions such as shearing or cutting sheet metal, and that the grasping, wire cutting and bolt turning regions described above may be arranged in different arrangements relative to each other.

Figure 7:
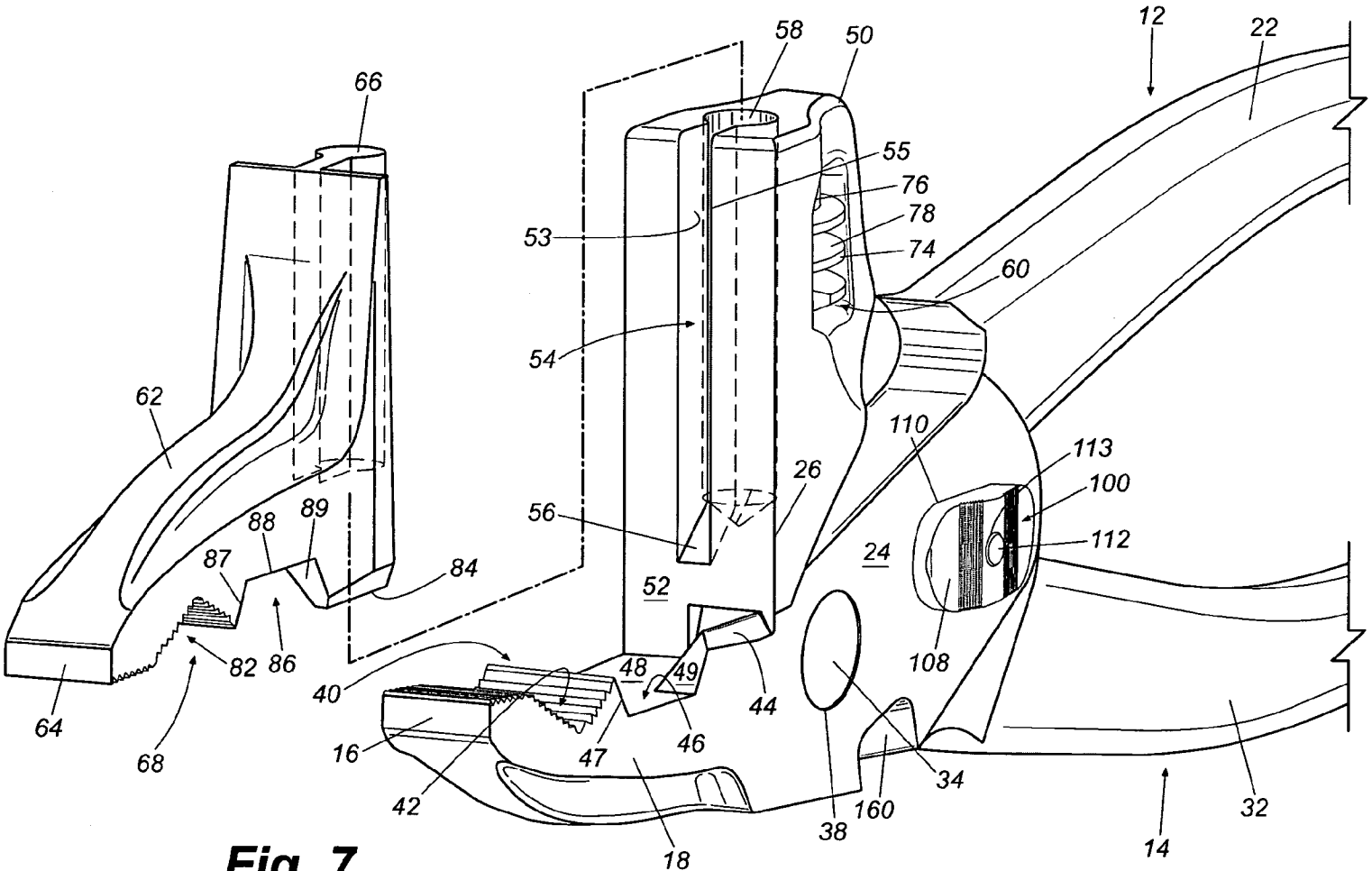
FIG. 7 is a partially-exploded front perspective view of the handle tool of FIG. 1.

Second member pivot portion 28 has a lobe 50 having an end face 52 that partially defines second member first end 26. Lobe 50 extends from second member pivot portion 28 radially outward from second pivot hole 38. Referring to FIG. 7, lobe end face 52 defines a slot 54 that has a first wall 53, a second wall 55, a first closed end 56 located proximate to second pivot hole 38 and a second open end 58 distal from the second pivot hole. Slot 54 communicates with an open recess 60 defined through second member lobe 50.

Referring to FIG. 3, hand tool 10 includes a sliding jaw 62 that allows the hand tool to perform the function of a typical adjustable wrench. Sliding jaw 62 has a first end 64, a second end 66 having a bulb-shaped profile, and a jaw face 68. Second member slot 54 slidably receives sliding jaw second end 66, which has a gear rack 70 that includes a plurality of gear teeth 72. When fully assembled, sliding jaw gear rack 70 is partially received in open recess 60, as shown in FIGS. 1 and 2. Referring to FIG. 3, open recess 60 receives a worm gear 74 having a shaft portion 76, a gear thread 78 and a pivot hole 79. Open recess 60 has a first bushing hole 81 and a second bushing hole 83 that receive a worm gear pivot rod 80. Bushing holes 81 and 83 hold pivot rod 80 in place allowing worm gear 74 to pivot about the pivot rod due to the clearance between an inner surface of pivot hole 79 and an outer surface of the pivot rod. Worm gear thread 78 engages sliding jaw gear rack teeth 72 as described in further detail below.

Sliding jaw face 68 may have a grasping region 82 located proximate to sliding jaw first end 64 that cooperate with first member jaw grasping region 42 for grasping rusty nails, electrical wires, or other similar materials that have rough surfaces. Additionally, jaw face 68 may have a wire cutting edge 84 located proximate to sliding jaw second end 66 opposite first jaw cutting edge 44. Preferably, jaw face 68 also has a bolt turning region 86 that includes three flat surfaces 87, 88, and 89 positioned opposite first jaw bolt turning region 46 for engaging the flat surfaces of a hexagonal bolt head, nut, or the flat surfaces on many common pipe fittings and other similar hardware. It should be understood that jaw face 68 may have other regions suited for other functions such as shearing or cutting sheet metal, and that the grasping, wire cutting and bolt turning regions described above may be arranged in different arrangements relative to each other, but it should be understood that corresponding regions on first member jaw 18 and sliding jaw 62 must be arranged symmetrically so as to perform their intended functions properly.

Figure 6A:
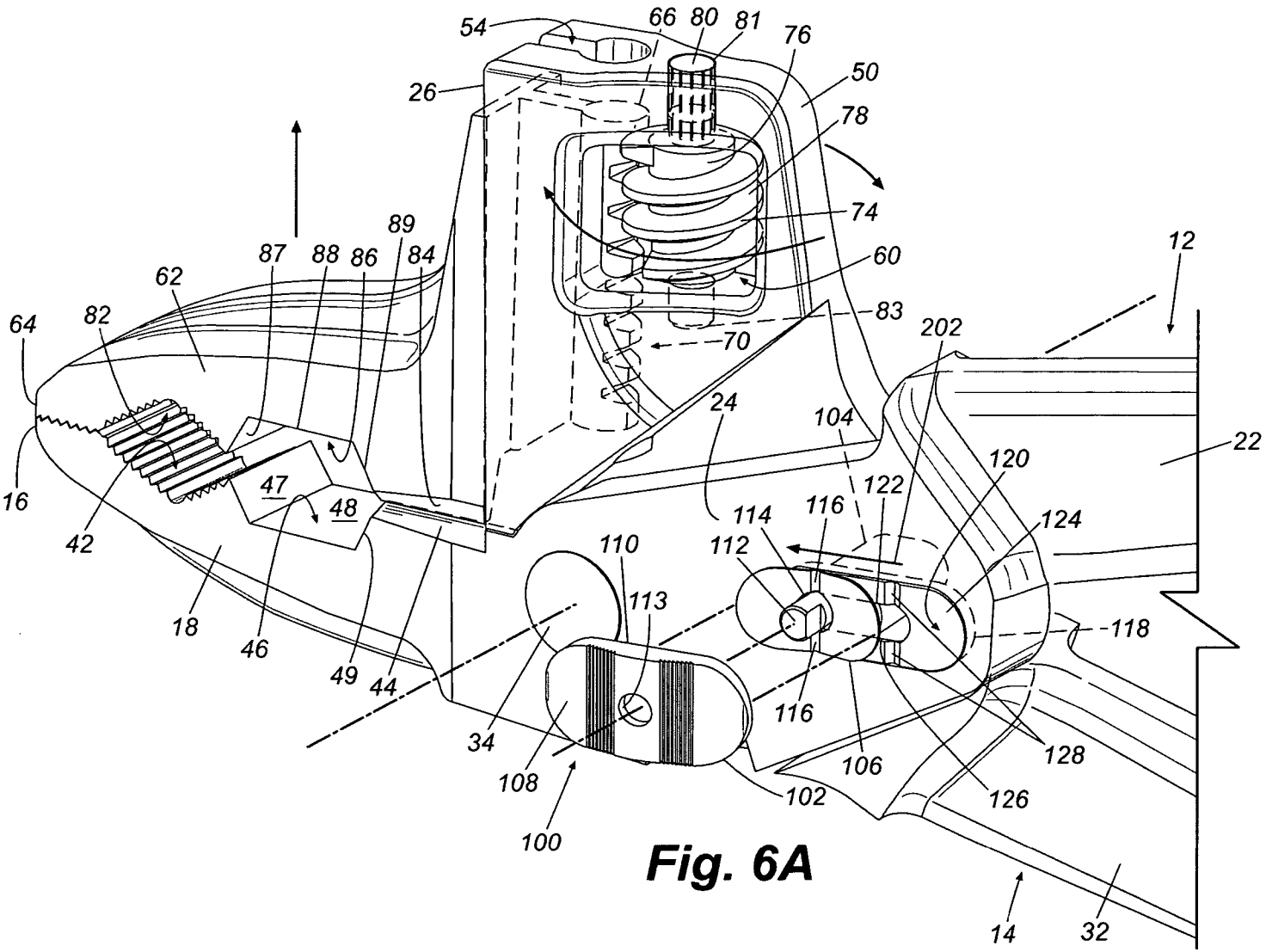
FIG. 6A is a front detailed perspective view of the hand tool of FIG. 1.
Figure 6B:
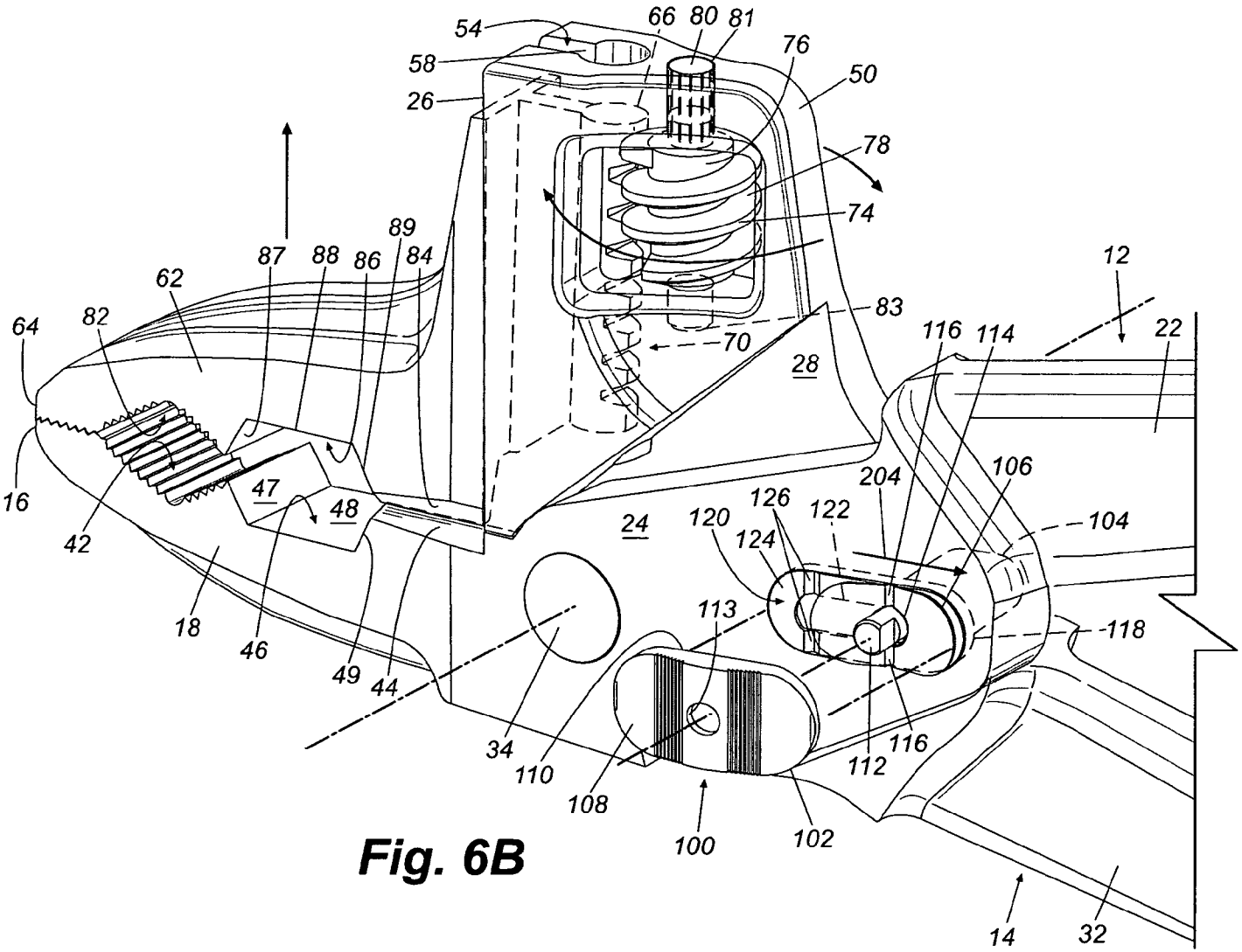
FIG. 6B is a front detailed perspective view of the hand tool of FIG. 1.

Referring to FIGS. 3, 6A and 6B, one preferred embodiment of tool 10 includes a sliding detent 100 that prevents first member 12 and second member 14 from pivoting about pivot pin 34 with respect to each other. Sliding detent 100 has a thumb button 102, a detent post 104 and a sheet bar 106 (FIGS. 3, 6A, and 6B). Thumb button 102 has a top surface 108 and a bottom surface 110 that together define a recess 113. Detent post 104 has a connecting portion 112 that is received in thumb button recess 113. Sheet bar 106 includes a through hole 114 formed in a bend 116 defined at the longitudinal center of the sheet bar.

A through-slot 118 is formed in first member pivot portion 24 at a position proximate to first handle 22. Through slot 118 is closed on all sides and has a counter-bored portion 119 (FIG. 3) that retains a detent cover 120 (FIGS. 3, 6A, and 6B) preferably by press fitted engagement. Detent cover 120 has a longitudinal through-slot 122 and a top surface 124 having first and second detent grooves 126 (FIGS. 3 and 6A) and 128 (FIGS. 3 and 6B). During assembly of tool 10, sheet bar 106 is sandwiched between detent cover top surface 124 and thumb button bottom surface 110 such that bend 116 extends outwardly from thumb button bottom surface 110 into engagement with one of detent cover grooves 126 and 128. Sheet bar through-hole 114 aligns both with detent cover longitudinal through-slot 122 and thumb button recess 113. During assembly, detent post connecting portion 112 passes through detent cover through-slot 122 and sheet bar through-hole 114 and is press-fitted into thumb button recess 113. In this way, detent thumb button 102, sheet bar 106, and detent post 104 may slide as a unitary assembly from a first position shown in FIG. 6A where sheet bar bend 116 engages detent cover first groove 126 to a second position shown in FIG. 6B where the sheet bar bend engages detent cover second groove 128.

Referring to FIGS. 2 and 3, second member pivot portion 28 has a locking slot 130 formed at a position proximate to second handle 32. When first member 12 and second member 14 are placed in a closed position, or the position where first handle 22 and second handle 32 are generally parallel to each other as shown in FIGS. 1 and 2, second member locking slot 130 aligns with first member through-slot 118 allowing the user to slide detent 100 in the direction of arrow 202 (FIG. 1) into a first locking position (FIG. 6A) where sheet bar bend 116 engages detent cover first groove 126, and second member locking slot 130 receives detent post 104. This position ensures that first member 12 and second member 14 are pivotally fixed with respect to each other. In a second unlocked position, first and second member 12 and 14 can pivot with respect to each other about pivot in 34, thus operating as a traditional pair of pliers.

It should be understood from the figures that the area of first member 12 where through slot 118 is formed is thicker than the area of second member 14 where slot 130 is formed. Thus, a larger length of detent post 104 is received in through slot 118 than in slot 130. This configuration is advantageous when the tool is used as an adjustable wrench. In particular, as torque is applied on a workpiece between the jaws, a twisting force is exerted on detent post 104 by first and second members 12 and 14. The twisting force causes detent post 104 to canter in slots 118 and 130. However, because a larger portion of the length of detent post 104 is received in slot 118 as compared to slot 130, there are two points of contact between the walls of slot 118 and detent post 104 and only one point of contact between detent post 104 and slot 130. As a result, the twisting force is received by the walls of slot 118, which are stronger than the walls of slot 130. If, on the other hand, a larger length of detent post 104 is received in slot 130, then two contact points would result between detent post 104 and the walls of slot 130 and only one point of contact would exist between detent post 104 and the walls of slot 118. In this configuration, because one side of slot 130 is open, the twisting force applied to the walls of slot 130 would pry the opposing walls apart from each other causing the locking mechanism to fail. Thus, in preferred embodiments, a larger length of detent post 104 should be received in slot 118 as compared to slot 130.

Figure 4:
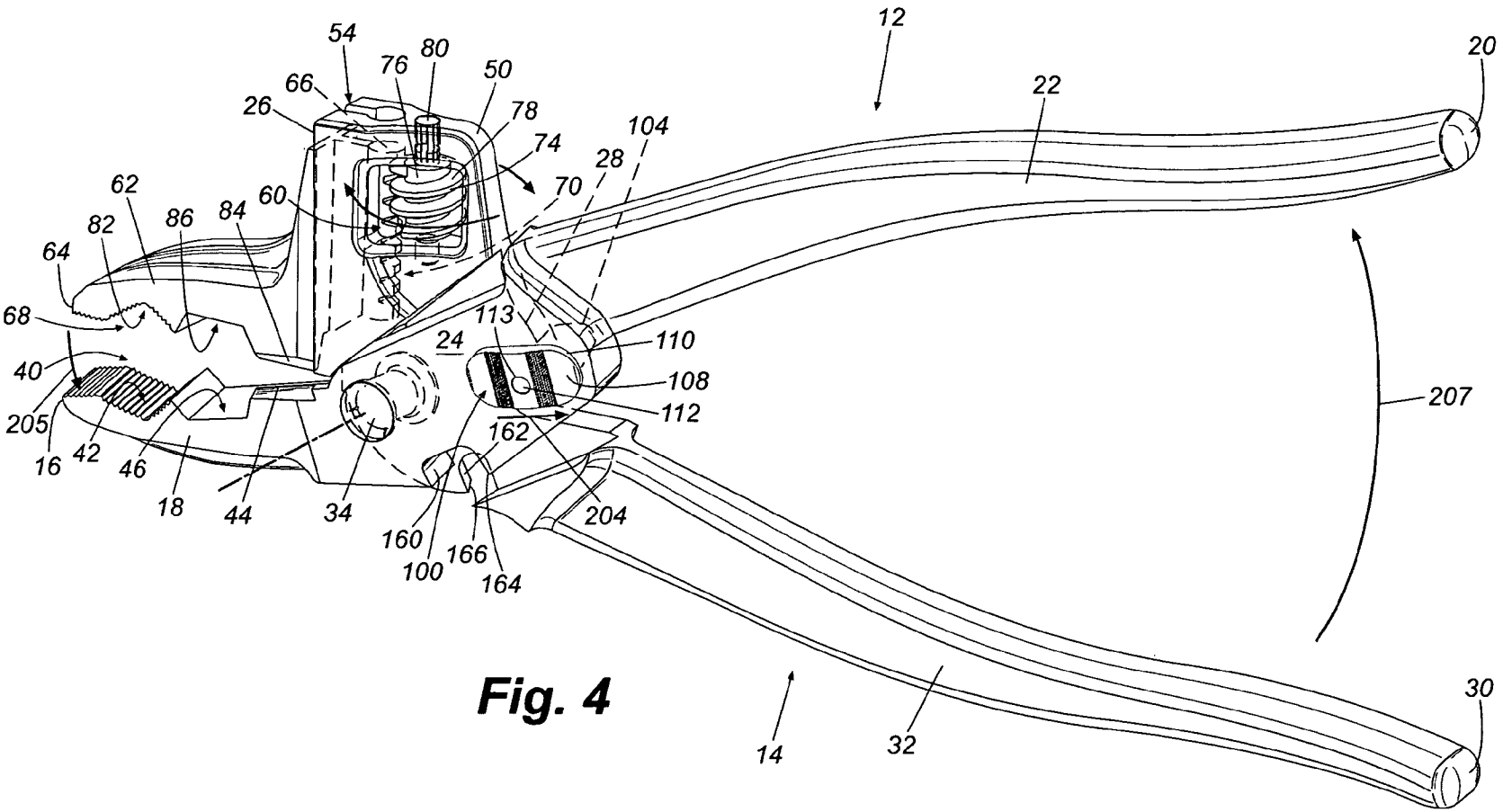
FIG. 4 is a front perspective view of the hand tool of FIG. 1 shown in a second operating position.

In operation, hand tool 10 may perform the operations of pair of pliers and an adjustable wrench among other things. Referring to FIGS. 4 and 6B, detent 100 is shown in the second unlocked position where detent post 104 is removed from the second member locking slot 130 (FIGS. 2 and 3). In this position, first member 12 and second member 14 may pivot with respect to each other in a closing direction indicated by arrows 205 and 207 that brings first handle jaw face 40 and sliding jaw face 68 into close proximity with each other, or the operator may pivot the first and second members in a direction opposite of arrow 207 so that jaw face 40 and sliding jaw face 68 spread apart from each other. When jaw 18 and sliding jaw 62 are in close proximity to one another, the user may squeeze first and second handles 22 and 32 together so that grasping portions 42 and 82 exert a grasping force on materials or a work piece. Similarly, squeezing handles 22 and 32 together brings cutting edges 44 and 84 into engagement for cutting or shearing electrical wires, metal bar stock or other work pieces.

As previously discussed, pivot pin 34 is located at a position that minimizes the distance between both the first member jaw face second end 45 and second member first end 26 and the pivot pin center 35 (FIG. 3). In one preferred embodiment, pivot pin 34 has a diameter within the range of 4-10 millimeters, and most preferably 7.8 millimeters. Pivot pin center 35 (FIG. 3) serves as the center of pivotal rotation about which the first and second members pivot with respect to each other during pliers operations. Maintaining the pivot pin diameter within the range of 4-10 mm allows pivot pin center 35 to be positioned very close to both first member jaw face second end 45 and second member first end 26, thereby increasing the mechanical advantage of the tool while maintaining the tool's mechanical integrity. Preferably, the distance between first member jaw face second end 45 and pivot pin center 35, represented by a dimension line 41, is within the range of 6-15 millimeters, and most preferably 11.6 millimeters. Similarly, the minimum distance between the nearest point on sliding jaw cutting edge 84 and center 35 is also within the range of 6-15 millimeters. This arrangement represents a significant improvement over prior art tools where the location of various moving parts at or near the center of pivotal movement requires an increased distance between the engaging surfaces on the jaw faces and the center of the pivot pin.

Figure 5:
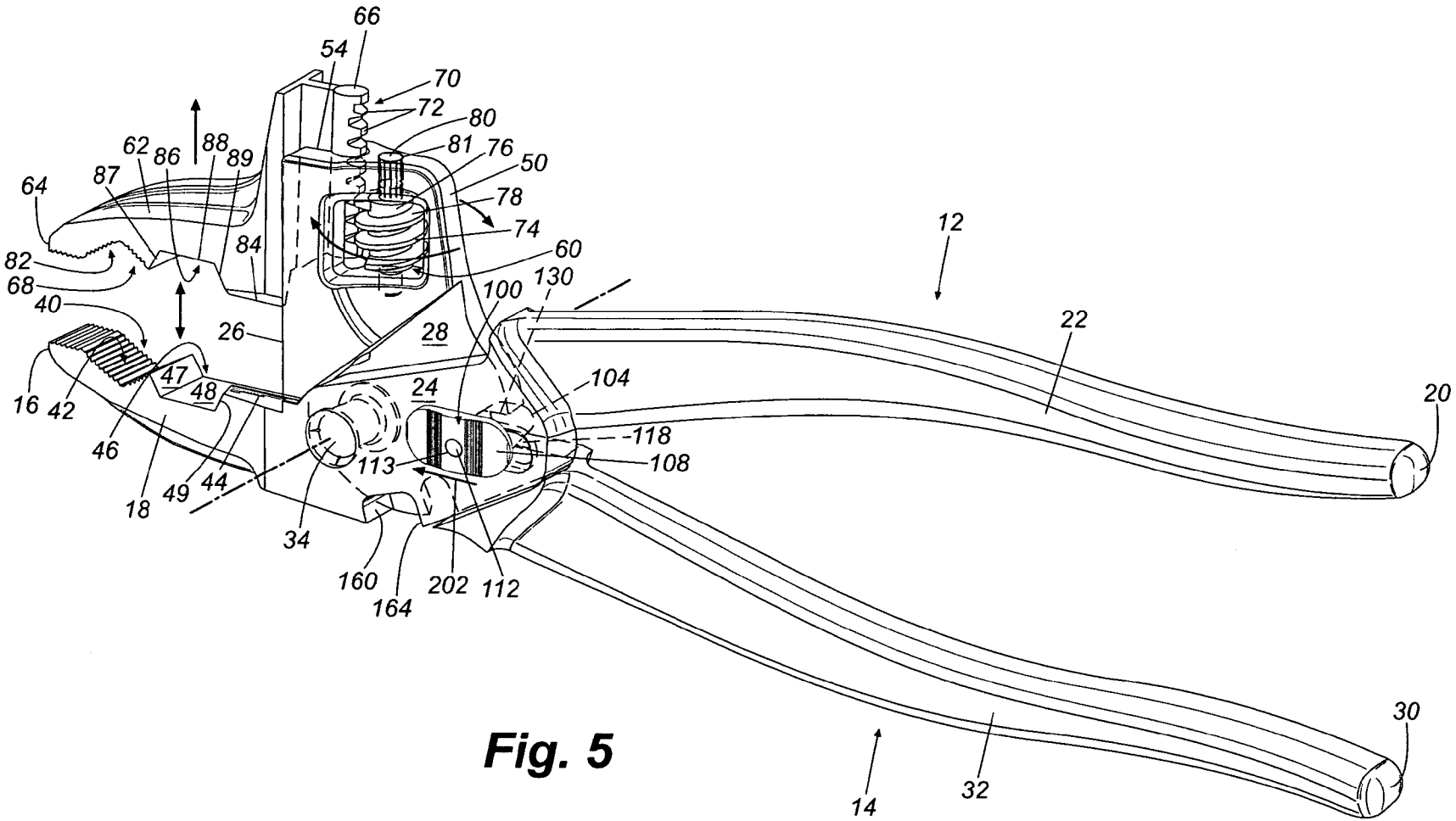
FIG. 5 is a front perspective view of the hand tool of FIG. 1 shown in a third operating position.

Referring to FIG. 5, hand tool 10 may also perform an adjustable wrench function when detent 100 is placed in the first position rotationally locking first member 12 and second member 14 with respect to one another. Placing detent 100 in the first position ensures that the first and second members will not pivot about pivot pin 34 with respect to each other when using hand tool 10 to perform wrenching functions on a work piece (not shown). The user may rotate worm gear 74 about pivot rod 80 and adjust the position of sliding jaw 68 with respect to jaw 18 to accommodate work pieces of varying sizes. Worm gear thread 76 engages sliding jaw gear rack teeth 72, and as the worm gear rotates, the gear thread advances the gear rack moving sliding jaw 68 back and forth within second member slot 54. Once the operator positions the sliding jaw where the distance between the jaw faces 68 and 40 is appropriate for the work piece, the user may perform the desired wrenching functions.

In the present invention, the location of center 35 helps maximize the amount of gripping or cutting leverage, also known as mechanical advantage, that the tool may exert on a work piece without compromising the mechanical integrity of first and second members 12 and 14. For example, in one preferred embodiment, the distance between pivot pin center 35 and the first end 16 and sliding jaw first ends 64 is approximately 57.5 millimeters, while the distance between pivot center 35 and first and second member second ends 20 and 30 is approximately 165 millimeters. In this arrangement, if the distance between pivot pin center 35 and first member jaw face second end 45 is 11.6 millimeters, the tool will offer a mechanical advantage in the range of 2.83 to 14.05. The mechanical advantage value of 2.83 represents the mechanical advantage at the first jaw and sliding jaw first ends 16 and 64, and the mechanical advantage value of 14.05 represents the mechanical advantage at first jaw face second end 45. The above described configuration provides a combination pliers/adjustable wrench that meets or exceeds the ASME standards for a nine inch linesmen tool and a six inch adjustable wrench. In particular, the above design will cut a 0.091 inch diameter wire at cutting edges 44 and 84 with less than 1020 in/lbs of cutting force and can apply a minimum rotational torque of 1450 in/lbs between surfaces 48 and 88 to a workpiece.

It should also be understood that the mechanical advantage of the tool can be increased by increasing the distance between pivot pin center 35 and first and second member second ends 20 and 30. Moreover, the overall scale of the tool can be changed by scaling the dimensions of the tool. For example, for a six inch adjustable pliers, a scale factor of 0.666 (6 in/9 in) results in the distance between pivot pin center 35 and jaw first ends 16 and 64 of approximately 38.3 millimeters, while the distance between pivot center 35 and first and second member second ends 20 and 30 is approximately 110 millimeters. In this arrangement, if the distance between pivot pin center 35 and first member jaw face second end 45 is 7.73 millimeters, the tool will offer a mechanical advantage in the range of 2.87 to 14.23. The mechanical advantage value of 2.87 represents the mechanical advantage at jaw first ends 16 and 64, and the mechanical advantage value of 14.23 represents the mechanical advantage at first jaw face second end 45. The above described configuration provides a combination pliers/adjustable wrench that meets or exceeds the ASME standards for a six inch linesmen tool and a four inch adjustable wrench. That is, the above design will cut a 0.08 inch diameter wire at cutting edges 44 and 84 with less than 600 in/lbs of force and can apply a minimum rotational torque of 600 in/lbs at surfaces 48 and 88 to a workpiece.

Referring to FIG. 7, as the user applies torque to the first and second handles, the clearance between second member slot 54 and bulb-shaped sliding jaw second end 66 will allow sliding jaw 62 to pivot within slot 54. That is, the portion of sliding jaw rack 70 closest to closed end 56 will rotate upward against slot walls 53 and 55 exerting a spreading force on opposing side walls 53 and 55. However, slot 54 offers an advantage over prior art tools because slot closed end 56 reinforces sidewalls 53 and 55 to help prevent the sidewalls from deforming or mechanically weakening when sliding jaw second end 66 imparts a spreading force upon them during wrenching, grasping or cutting functions.

Figure 8:
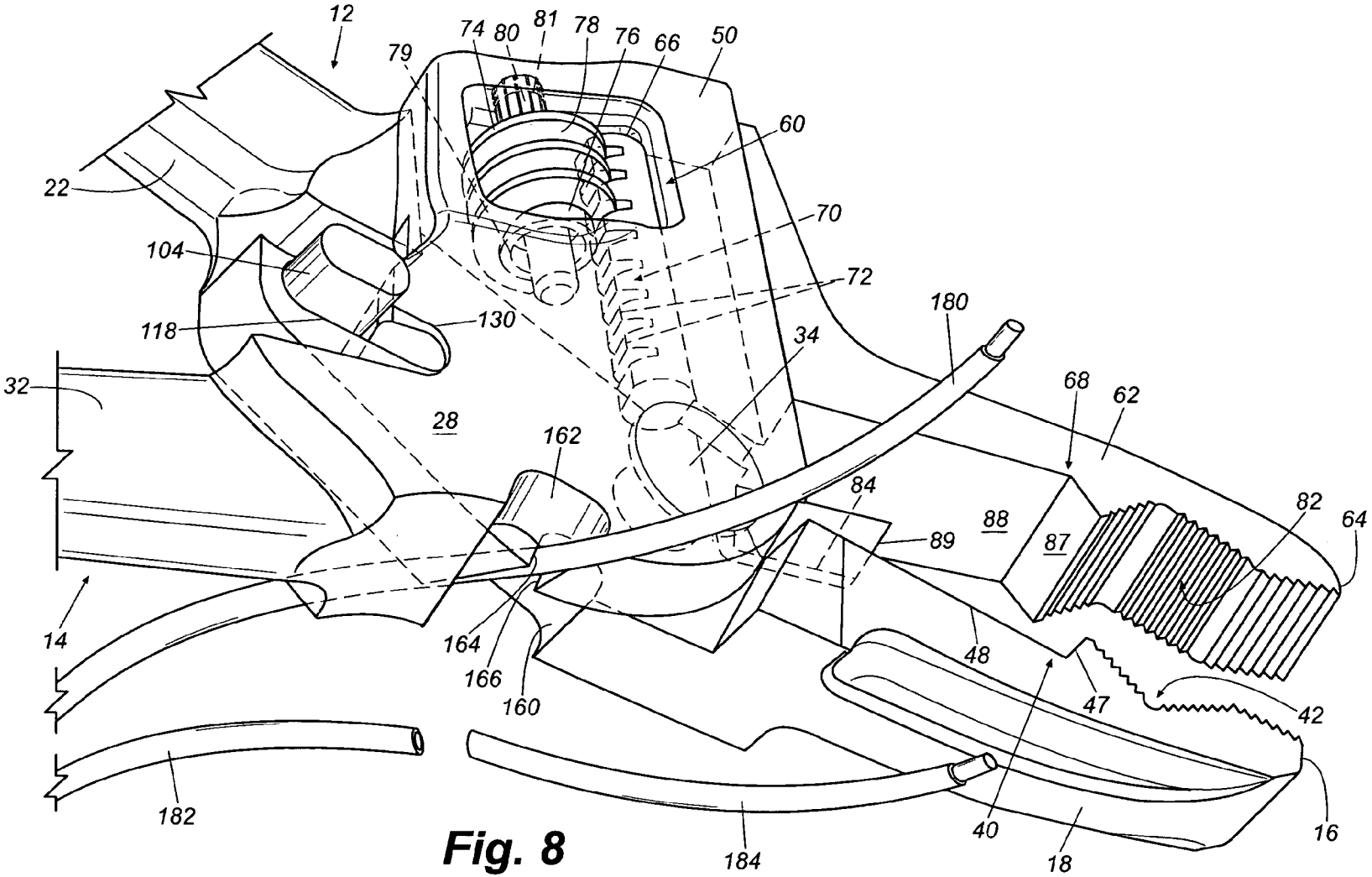
FIG. 8 is a rear detailed perspective of the hand tool of FIG. 1.

Referring to FIG. 8, in one preferred embodiment of the present invention, first member 12 includes a first large-gauge wire-cutting recess 160 formed in first handle pivot portion 24 proximate to pivot pin 34. Similarly, second member 14 includes a second large-gauge wire cutting recess 162 formed in second handle pivot portion 28 proximate to pivot pin 34. Recesses 160 and 162 each have a respective wire cutting edge 164 and 166 that are sized appropriately to receive wires having a large gauge, such as wires with American Wire Gage values from 4/0 to 10. Large-gauge wires would be difficult or impossible to cut cleanly using first and second jaw face wire cutting edges 44 and 84 and may damage the cutting edges 44 and 84. Recesses 160 and 162 are positioned such that they align when first handle 22 and second handle 32 are spread apart. The user may then place a wire 180 into aligned large-gage wire cutting recesses 160 and 162 and then squeeze handles 22 and 32 together. As the user squeezes the handles together, wire cutting edges 164 and 166 perform a scissoring function, thereby cross-cutting the wire into two sections 182 and 184. Both of the large-gauge wire-cutting recesses are positioned close to pivot pin 34 in order to maximize the amount of cutting leverage that the user creates by squeezing the handles together.

It should be appreciated by those skilled in the art that various modifications and variations can be made in the present invention without departing from the scope and spirit of the invention. It is intended that the present invention cover such modifications and variations as come within the scope and spirit of the appended claims and their equivalents.

What is claimed is:

1. A hand tool comprising:

a. a first member having i. a first handle, ii. a fixed jaw having a face defining a first end distal from said first handle and a second end proximate to said first handle, and iii. a first pivot portion intermediate said fixed jaw and said handle, said first pivot portion defining a first pivot hole having a center positioned at a distance from said fixed jaw face second end within the range of about 6 to 15 millimeters;

b. a second member having i. a first end defining a slot generally transverse to an axis of said second member, ii. a second end defining a second handle, iii. a second pivot portion proximate to said slot and defining a second pivot hole, iv. a recess defined through said second member proximate to said second member slot and disposed radially outward from said second member second pivot hole, and v. a gear rotatably received in said recess, c. a pivot pin pivotally connecting said first and second members so that said first and said second members pivot between a fully closed position and a fully open position, said pivot pin having a diameter within the range of about 4 to 10 millimeters and being received in both said first pivot hole and said second pivot hole; and d. a sliding jaw having i. a face, and ii. a gear rack defining a first end proximate to said sliding jaw face and a second end distal from said sliding jaw face, said sliding jaw face having a first end distal from said gear rack and a second end proximate said gear rack, wherein said gear rack is slidably received by said second member slot so that rotation of said gear moves said sliding jaw within said second member slot, wherein the hand tool further comprises a detent selectively movable to prevent the pivotal movement of said first member and said second member with respect to each other, said detent being slidably movable in a slot defined through said first member, said slot positioned intermediate said first pivot hole and said first member handle; the tool further comprising a second slot in said second member that aligns with first member slot, and wherein e. said detent has an axial length, f. when said detent is in a first position, said detent is received by said first member slot and said second member second slot, and g. a larger axial length of said detent is received in said first member slot than in said second member second slot.

2. The hand tool of claim 1, wherein said hand tool is at least four inches long and can apply a torque of at least 600 in/lbs.

3. The hand tool of claim 1, said detent further comprising a. a thumb slide having a first surface for engagement by an operator and a second surface, b. a locking post extending from said second surface, and c. a resilient detent clip for releasably holding said detent in one of a first position for pivotally immobilizing said first and second members with respect to each other and a second position for allowing said first and second members to pivot with respect to each other.

4. The hand tool of claim 1, wherein a. said fixed jaw face further defines a plurality of gripping recesses intermediate said fixed jaw face first and second ends and a cutting edge proximate to said fixed jaw face second end, and said sliding jaw face defines a plurality of gripping recesses intermediate said sliding jaw face first and second ends and a cutting edge proximate said sliding jaw face second end; and b. wherein said fixed jaw face cutting edge engages said sliding jaw face cutting edge when said first handle and said second handle are closed.

5. The hand tool of claim 1, wherein a. said first member has a first large-gauge wire cutting recess located proximate to said first member first pivot hole, and said second member has a second large-gauge wire cutting recess located proximate to said second member second pivot hole, and b. said first and second large-gauge wire cutting recesses cooperate to cut a section of large-gauge wire inserted into said first and second large-gauge wire cutting recesses when said first member and said second member are pivoted with respect to each other from said open position to said closed position.

6. The hand tool of claim 1, said second member slot having an open first end distal from said second member pivot hole and a closed second end proximate to said second member pivot hole.

7. A hand tool comprising:

a. a first member having i. a first handle, ii. a fixed jaw having a face defining a first end distal from said handle and a second end proximate to said handle, and iii. a first pivot portion intermediate said fixed jaw and said handle and defining a first pivot hole;

b. a second member having i. a first end defining a slot generally transverse to an axis of said second member, ii. a second end defining a second handle, iii. a second pivot portion proximate to said slot defining a second pivot hole, iv. a recess defined through said second member proximate to said second member slot and disposed radially outward from said second member pivot point, and v. a gear rotatably received in said recess, c. a pivot pin received in both of said first and second pivot holes and pivotally connecting said first pivot portion and said second pivot portion so that said first and second handles pivot between a fully closed position and a fully open position, said pivot pin having a diameter within in the range of about 4 to 10 millimeters; and d. a sliding jaw having i. a face, and ii. a gear rack defining a first end proximate to said sliding jaw face and a second end distal from said sliding jaw face, said sliding jaw face having a first end distal from said gear rack and a second end proximate said gear rack, wherein said gear rack is slidably received by said second member slot so that rotation of said gear moves said sliding jaw within said second member slot, wherein the hand tool further comprises a detent selectively movable to prevent the pivotal movement of said first member and said second member with respect to each other, said detent being slidably received in a slot defined through said first member, said slot positioned intermediate said first pivot hole and said first member handle; the detent further comprising a. a thumb slide having a first surface for engagement by an operator and a second surface, b. a locking post extending from said second surface, and c. a resilient detent clip for releasably holding said sliding detent in one of a first position for pivotally immobilizing said first and second members with respect to each other and a second position for allowing said first and second members to pivot with respect to each other.

8. The hand tool of claim 7, wherein said hand tool can apply a rotational torque of at least 600 in/lbs.

9. The hand tool of claim 7, wherein said hand tool can apply a rotational torque of at least 1450 in/lbs.

10. The hand tool of claim 7, wherein a. said sliding jaw is movable within said second member slot between a first position proximate said fixed jaw face and a second position distal from said fixed jaw face, b. wherein said sliding jaw gear rack defines a first edge proximate said sliding jaw face and a second edge distal from said sliding jaw face, and c. wherein said gear rack first edge engages said second member slot closed second end when said sliding jaw is in said first position.

11. The hand tool of claim 7, wherein a. said first member has a first large-gauge wire cutting recess located proximate to said first member first pivot hole, and said second member has a second large-gauge wire cutting recess located proximate to said second member second pivot hole, and b. said first and second large-gauge wire cutting recesses cooperate to cut a section of large-gauge wire inserted into said first and second large-gauge wire cutting recesses when said first member and said second member are pivoted with respect to each other from said open position to said closed position.

12. A hand tool comprising:

a. a first member having i. a first handle defining a first end, ii. a fixed jaw having a face defining a first end distal from said handle and a second end proximate to said handle, and iii. a first pivot portion intermediate said fixed jaw and said handle and defining a first pivot hole;

b. a second member having i. a first end defining a slot generally transverse to an axis of said second member, ii. a second end defining a second handle, iii. a second pivot portion proximate to said slot defining a second pivot hole having a center, iv. a recess defined through said second member proximate to said second member slot and disposed radially outward from said second member pivot point, and v. a gear rotatably received in said recess, said second member slot having an open first end distal from said second end member pivot hole and a closed second end proximal to said second member pivot hole;

c. a pivot pin received in both said first and second pivot holes and pivotally connecting said first and said second pivot portions so that said first and second members pivot about said pivot pin between a fully closed position and a fully open position, and d. a sliding jaw having i. a gear rack slidably received by said second member slot so as to engage said gear so that rotation of said gear causes said sliding jaw to move within said slot, and ii. a jaw face having a first end distal from said sliding jaw gear rack and a second end proximal to said gear rack, wherein the hand tool further comprises a detent selectively movable to prevent the pivotal movement of said first member and said second member with respect to each other, said detent being slidably movable in a slot defined through said first member, said slot positioned intermediate said first pivot hole and said first member handle; the tool further comprising a second slot in said second member that aligns with first member slot, and wherein e. said detent has an axial length, f. when said detent is in a first position, said detent is received by said first member slot and said second member second slot, and g. a larger axial length of said detent is received in said first member slot than in said second member second slot, and wherein said hand tool can apply a torque to a workpiece of at least 600 in/lbs.

13. The hand tool of claim 12 wherein a. both said first pivot hole center and said first handle first end and said second pivot hole center and said second member second end are separated by a distance within the range of about 140 to 250 millimeters, and b. wherein both said fixed jaw face first end and said first pivot hole center and said sliding jaw face first end and said second pivot hole center are separated by a distance within the range of about 45 millimeters to 90 millimeters.

14. The hand tool of claim 12 wherein said pivot pin has a diameter within the range of 4 to 10 millimeters.

15. The hand tool of claim 7, said second member slot having an open first end distal from said second member pivot hole and a closed second end proximate to said second member pivot hole.

* * * * *